United States Patent [19]

Lang

[11] 4,440,356

[45] Apr. 3, 1984

[54] MACHINE FOR SEPARATING AND SLITTING THIN SHEET

[75] Inventor: John C. Lang, Nashville, Tenn.

[73] Assignee: Erwin Kampf GmbH & Co., Wiehl, Fed. Rep. of Germany

[21] Appl. No.: 285,987

[22] Filed: Jul. 23, 1981

[51] Int. Cl.[3] ..... B65H 35/02

[52] U.S. Cl. ..... 242/56.5

[58] Field of Search ..... 242/56.5, 56.2, 56.3, 242/56.4, 56.6, 56.7

[56] References Cited

U.S. PATENT DOCUMENTS

| | | | |
|---|---|---|---|
| 708,722 | 9/1902 | Mather | 242/56.5 |
| 1,314,786 | 9/1919 | Cameron | 242/56.5 |
| 1,326,644 | 12/1919 | Cameron | 242/56.5 |
| 3,282,526 | 11/1966 | Daly | 242/56.2 X |

*Primary Examiner*—Edward J. McCarthy

*Attorney, Agent, or Firm*—Joseph A. Geiger

[57] ABSTRACT

Machine for separating and longitudinally slitting thin sheet, especially double-rolled aluminum sheet or foil, and for winding it onto two winding shafts in abutting strip coils, each winding station including a displaceable cylinder-biased winding carriage with a deflecting roll and a pressure roll defining a terminal sheet run unaffected by the carriage position. Slitting knives arranged on a rotatable swivel shaft in the winding carriage reach into the sheet path in its terminal run, just ahead of the winding point, the slitting knives being retractable into a safe position through rotation of the swivel shaft.

4 Claims, 1 Drawing Figure

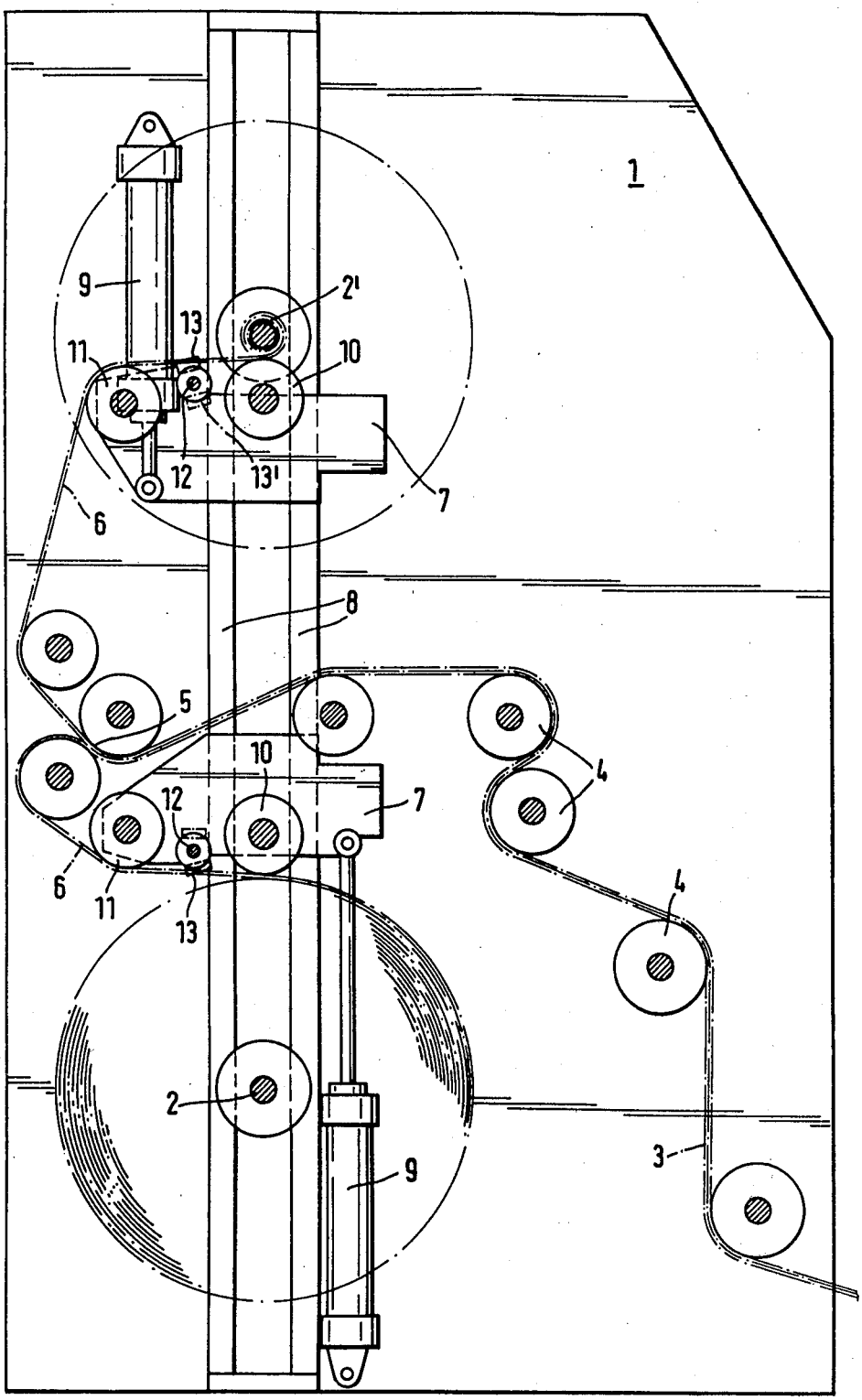
1
9
2'
13
11
10
12
13'
7
6
8
5
10
4
12
7
6
11
13
4
2
9
3

MACHINE FOR SEPARATING AND SLITTING THIN SHEET

BACKGROUND OF THE INVENTION

1. Field of the Invention

The present invention relates to sheet slitting and winding devices, and more particularly, to a machine for separating double thin sheet, for longitudinally slitting the sheets, and for winding the sheet strips in lateral abutment onto a winding shaft.

2. Description of the Prior Art

It has become common practice to produce thin aluminum sheet, and especially aluminum foil in the form of a double sheet which is then separated into two sheets and longitudinally slitted into parallel strips. Heretofore, the longitudinal slitting necessitated the use of closely spaced double knives between adjacent sheet strips, in order to cut from the sheet a narrow strip which would then be sucked off by a vacuum pickup to create a small gap between adjacent strip coils on the winding shaft.

Ideally, longitudinally slitted sheet strips should be wound onto the winding shaft without gaps, in order to eliminate the loss and potential operating problems resulting from the gap production. For this to be possible, it is necessary that the sheet strips have absolutely consistant edges and are guided with absolutely no possibility of lateral drift. Obviously, the lateral drift between adjacent sheet strips is a function of the distance which they travel between the slitting station and the winding point on the winding shaft.

It has also been found that the problem of lateral drift is accentuated in the case of sheets which have been separated from a double sheet. The distance between the slitting station and the winding point is largely determined by the particular winding geometry of the machine which, as the winding diameter increases progressively, may undergo substantial changes from the smallest coil diameter to the largest coil diameter.

SUMMARY OF THE INVENTION

It is a primary objective of the present invention to offer an improvement in connection with this type of sheet separating and slitting machine by arranging the slitting station in such a way that the previously encountered lateral drift of the sheet strips is positively eliminated, so that the sheet strips can be wound in abutting strip coils onto the winding shaft.

The present invention proposes to attain this objective by suggesting the arrangement of the slitting knives on a guided winding carriage, in the immediate vicinity of the winding point on the coil, while maintaining a winding geometry at the slitting station which remains unchanged, as the winding carriage is displaced by the increasing coil diameter.

The arrangement of the slitting station on the winding carriage makes it possible to position the slitting knives just ahead of the winding point, immediately adjacent to the pressure roll. This way, the winding geometry remains unchanged to the extent that it affects the slitting station, as the latter maintains an unchanging relationship with the winding point in all positions of the winding carriage.

In a preferred embodiment, the invention further suggests that the slitting knives be arranged between the pressure roll and a deflecting roll which is likewise journalled on the winding carriage, in order to produce a short terminal sheet run for the slitting station which remains unchanged, regardless of the position of the winding carriage.

The invention further suggests an arrangement of the slitting knives which provides for the latter to be retractable away from the sheet path in the terminal run, as an additional safety feature for the machine of the invention. The slitting knives are to be retracted, whenever the machine is serviced. The proposed retraction feature is preferably in the form of a swivel shaft carrying the slitting knives, so that a half-turn rotation of the shaft will retract the knives from the sheet path to the opposite side of the shaft. This feature renders service access and work on the winding carriage and winding mechanism safer and more convenient.

BRIEF DESCRIPTION OF THE DRAWINGS

Further special features and advantages of the invention will become apparent from the description following below, when taken together with the accompanying drawing which illustrates, by way of example, an embodiment of the invention which is represented as follows:

The sole FIGURE shows, in a somewhat schematic elevational view, the essential elements of a machine for separating and slitting thin sheet.

DESCRIPTION OF THE PREFERRED EMBODIMENT

The drawing shows a generally rectangular side frame 1 of the machine structure. This frame carries suitable bearings and known release mechanisms for two vertically spaced winding shafts 2 and 2'. The machine under consideration is specifically adapted for the separation and longitudinal slitting of thin aluminum sheet or aluminum foil. The double sheet 3 arrives in the machine from a supply roll (not shown), running over a series of driven and non-driven guide rolls and deflecting rolls 4 in the direction of a separating station 5, where the doubled sheet 3 is separated into single-thickness sheets 6. The single sheets 6 then travel in generally opposite directions towards the winding shafts 2 and 2', respectively.

Each winding station comprises a winding carriage 7 which is guided on guide rails 8 for displacement in a direction perpendicular to the axis of the winding shaft 2 or 2', respectively. Each winding carriage 7 is movable radially with respect to its winding shaft by means of a cylinder unit 9. Each winding carriage 7 carries a pressure roll 10 and a deflecting roll 11 spaced a short distance from the pressure roll 10. The latter is so positioned in the winding carriage that it moves in a radial plane relative to the winding shaft 2 or 2'. The pressure roll 10 serves to maintain a predetermined winding pressure which is produced, in an adjustable way, by the cylinder unit 9.

In the space between the pressure roll 10 and the deflecting roll 11 is arranged a swivel shaft 12 which has attachment means for a plurality of transversely spaced slitting knives 13. The drawing shows, in full lines, the normal operating position of the slitting knives 13. In this position, the knives reach into the path of the sheet 6, thereby longitudinally cutting the latter. The resulting sheet strips are immediately wound into strip coils, free of intermediate gaps. As can be seen in the drawing, the length of the sheet path between the slitting point at 13 and the winding point on the coil is extremely short so that the adjoining sheet strips have no possibility of drifting laterally on this run. It follows that the edges of the sheet strips are clean and positively prevented from interfering with each other.

In the drawing, the winding configuration for the upper winding shaft 2' is shown at the start of the winding procedure, with the smallest-possible diameter of the coil and with the winding carriage 7 in its uppermost position, while the lower winding shaft 2 is shown with a full coil of maximum diameter and with its winding carriage 7 in its extreme extended position. By comparing these two extremes of carriage position, it can be seen that the winding geometry, as determined by the pressure roll 10 and the deflecting roll 11, remains unchanged at any coil diameter and that, consequently, the slitting geometry remains unchanged, because the slitting knives 13 are likewise carried by the winding carriage 7, remaining in a fixed position in relation to the terminal sheet run between the deflecting roll 11 and the pressure roll 10.

The swivel shaft 12 which carries the slitting knives 13 is rotatable by approximately 180°, so that the knives 13 can be retracted to the knive position 13' which is shown in stippled lines. In this position, the knives 13 are removed from the path of the sheet 6 and located on the opposite side of the swivel shaft 12, i.e. behind the latter. This feature assures that service personnel performing maintenance or adjustment work on the machine will not be injured.

It should be understood, of course, that the foregoing disclosure describes only a preferred embodiment of the invention and that it is intended to cover all changes and modifications of this example of the invention which fall within the scope of the appended claims.

I claim the following:

1. In a machine for processing a web of thin sheet, especially thin aluminum sheet or aluminum foil, which includes at least one driven winding shaft journalled in a stationary support structure of the machine and guide and deflecting rolls which lead the sheet toward a winding point at which the sheet is wound onto the winding shaft; in said machine, a device for longitudinally slitting the sheet into a plurality of sheet strips which are being wound onto the winding shaft in the form of longitudinally abutting strip coils, the device comprising in combination:

a winding carriage guided for displacement towards and away from the winding shaft;

a pressure roll journalled on the winding carriage so as to contact the strip coils at the winding point;

means for biasing the winding carriage towards the winding shaft so that the pressure roll exerts a radial winding pressure at the winding point, while progressively displacing the winding carriage away from the winding shaft, in response to the increase in diameter of the strip coils;

a sheet deflecting roll likewise journalled on the winding carriage, at a short distance from the pressure roll and ahead of the latter in the sense of sheet movement, the location of the deflecting roll being such that it deflects the sheet path in all positions of the winding carriage, thereby creating a terminal sheet run between the deflecting roll and the pressure roll which remains in an unchanging relationship relative to the winding carriage in all carriage positions; and a plurality of transversely spaced slitting knives arranged on the winding carriage in a position in which the knives reach into the path of the terminal sheet run, just ahead of the winding point.

2. A slitting device as defined in claim 1, wherein the winding carriage is guided along a straight-line guide in such a way that the displacement path of the winding point, as determined by the pressure roll, is substantially radial with respect to the winding shaft; and the winding carriage biasing means includes a cylinder unit.

3. A slitting device as defined in claim 1 or claim 2, wherein the winding carriage includes means for retracting the slitting knives out of the path of the terminal sheet run.

4. A slitting device as defined in claim 3, wherein the slitting knives retracting means includes a swivel shaft rotatably arranged in the winding carriage in parallel alignment with its pressure roll and deflecting roll and in proximity with the path of the terminal sheet run; and the slitting knives are carried by the swivel shaft in such a way that a rotation of the swivel shaft displaces the blades away from the terminal sheet run, to the opposite side of the swivel shaft.

* * * * *